US006733896B2

(12) United States Patent
Dolan et al.

(10) Patent No.: US 6,733,896 B2
(45) Date of Patent: May 11, 2004

(54) PROCESS FOR TREATING STEEL-, ZINC- AND ALUMINUM-BASED METALS USING A TWO-STEP COATING SYSTEM

(75) Inventors: Shawn E. Dolan, Sterling Heights, MI (US); Michael J. Kay, Sterling Heights, MI (US); Lawrence R. Carlson, Oxford, MI (US)

(73) Assignee: Henkel Corporation, Gulph Mills, PA (US)

( * ) Notice: Subject to any disclaimer, the term of this patent is extended or adjusted under 35 U.S.C. 154(b) by 48 days.

(21) Appl. No.: 10/076,582

(22) Filed: Feb. 15, 2002

(65) Prior Publication Data

US 2002/0122886 A1 Sep. 5, 2002

Related U.S. Application Data

(60) Provisional application No. 60/269,467, filed on Feb. 16, 2001.

(51) Int. Cl.[7] ..... B32B 15/04

(52) U.S. Cl. ..... 428/472; 428/472.1; 428/472.3; 148/247; 148/251; 148/256; 148/257; 148/262; 427/327

(58) Field of Search ..... 148/247, 251, 148/256, 257, 262; 428/472, 472.1, 472.3; 427/327

(56) References Cited

U.S. PATENT DOCUMENTS

| | | | | |
|---|---|---|---|---|
| 4,149,909 | A | 4/1979 | Hamilton | |
| 4,838,957 | A | 6/1989 | Miyamoto et al. | |
| 4,961,794 | A | 10/1990 | Miyamoto et al. | |
| 5,068,299 | A | 11/1991 | Lindert et al. | 526/313 |
| 5,073,196 | A | 12/1991 | Fotinos et al. | |
| 5,281,282 | A | 1/1994 | Dolan et al. | |
| 5,356,490 | A | 10/1994 | Dolan et al. | |
| 5,534,082 | A | 7/1996 | Dollman et al. | |
| 5,584,946 | A | 12/1996 | Karmaschek et al. | |
| 5,662,746 | A | 9/1997 | Affinito | 148/247 |
| 5,769,967 | A | 6/1998 | Dolan | |
| 5,851,371 | A | 12/1998 | Steinbrecher et al. | 204/486 |
| 5,891,952 | A | 4/1999 | McCormick et al. | |

FOREIGN PATENT DOCUMENTS

| | | |
|---|---|---|
| DE | 197 35 314 A1 | 3/1998 |
| WO | WO 99/12661 | 3/1999 |
| WO | WO 00/26437 | 5/2000 |
| WO | WO 00/68458 | 11/2000 |
| WO | WO 01/92597 A2 | 6/2001 |

*Primary Examiner*—Andrew L. Oltmans
(74) *Attorney, Agent, or Firm*—Brooks Kushman P.C.

(57) ABSTRACT

The present invention comprises a method for treating one or more multi-metal articles. The method comprises exposing the one or more articles to a first treatment composition capable of providing a conversion coating on steel- and zinc-based metal, and exposing the one or more articles to a second treatment coating composition suitable for providing a conversion coating on aluminum-based metal articles. Preferably, the first treatment composition comprises a zinc-phosphate conversion coating comprising, zinc ion, phosphate ion, manganese ion, and fluoride ion. Preferably, the second treatment composition comprises a ceramic composite treatment composition.

26 Claims, No Drawings

PROCESS FOR TREATING STEEL-, ZINC- AND ALUMINUM-BASED METALS USING A TWO-STEP COATING SYSTEM

CROSS-REFERENCE TO RELATED APPLICATIONS

This application claims the benefit of U.S. provisional application Serial No. 60/269,467 filed Feb. 16, 2001.

BACKGROUND OF THE INVENTION

1. Field of the Invention

The present invention relates to treating multi-metal articles using a two-step coating system and to metal articles coated in accordance with the two-step process. More particularly, the present invention relates to a two step process for treating one or more multi-metal articles with a first coating composition suitable for forming a conversion coating on steel- and zinc-based metals, followed by a second coating composition suitable for forming a conversion coating on aluminum-based metal, and to multi-metal articles so treated. More particularly, the present invention relates to treating one or more multi-metal articles in a conversion coating line with a phosphate coating composition and a ceramic composite coating composition.

2. Background Art

Applying conversion coatings, in general, is a well-known method of providing metals and their alloys with one or more layers or coatings that impart increased corrosion resistance and adhesion of subsequently applied finishes/coatings (i.e., paints, lacquers, varnishes, etc.) to the metals. Many metal line treatment processes contain a plurality of multi-metal articles. By multi-metal articles, it is meant (1) an article that has surfaces of steel- and/or zinc-based metal along with surfaces of aluminum-based metal, (2) at least a first article that has surfaces of steel- and/or zinc-based metal and at least a second article that has surfaces made of aluminum-based metal, or (3) both (1) and (2) described above. Historically, pre-treatment lines that have utilized predominately heavy metal substrates (i.e., typically having a line composition of less than 10–20% light metal such as aluminum-based metal) have practiced the art of zinc-phosphate conversion coating. The use of zinc-phosphate conversion coatings for treating metals that have been predominately heavy metals has been relatively successful. However, as light metal articles are becoming more common in automobiles and other products, the relative amount of, or percent of light metal articles requiring treatment has increased. In many instances, the percentage of the surface area of light metals in a treatment line can be as high as 75–85% or more of all the metal articles passing through the treatment line. It has been observed that zinc-phosphate conversion coating compositions have had difficulty in providing and maintaining a suitable conversion coating on aluminum-based surfaces when aluminum-based surfaces comprise a substantial, such as greater than 20–40%, proportion of the metal surfaces being processed/treated. This is because aluminum contamination removes fluoride and can aid in the precipitation of zinc-phosphate sludge, which can lower the zinc concentration.

Accordingly, it is an object of the present invention to provide a method for effectively treating one or more multi-metal articles, regardless of the relative amount of aluminum-based surfaces, and preferably where the surface area of the aluminum-based metal comprises greater than 20%, more preferable greater than 35%, and even more preferably greater than 60% of the total surface area of the sum of the multi-metal articles. It is also an object of the present invention to provide a multi-step coating method for effectively treating one or more multi-metal articles wherein prior coatings remain essentially undamaged by subsequent coatings.

SUMMARY OF THE INVENTION

It has been found that treating multi-metal articles by (i) exposing the articles to a phosphating composition capable of providing a conversion coating on steel- and zinc-based metals, and (ii) exposing the articles to a ceramic composite treatment comprising water and (A) a product of chemical interaction between (1) an amount, all of which is dissolved in the water, of a first initial reagent component selected from the group consisting of fluoroacids of the elements of titanium, zirconium, hafnium, boron, aluminum, silicon, germanium, and tin; and (2) an amount, which may be dissolved, dispersed or both dissolved and dispersed in the water, of a second initial reagent component selected from the group consisting of titanium, zirconium, hafnium, boron, aluminum, silicon, germanium, and tin and all of oxides, hydroxides, and carbonates of all of titanium, zirconium, hafnium, boron, aluminum, silicon, germanium, and tin is particularly effective in treating multi-metal articles passing through a treatment line over an extended period of time, regardless of the relative amount of aluminum-based surfaces passing through the treatment line.

DETAILED DESCRIPTION OF THE PREFERRED EMBODIMENTS

The present invention is particularly useful in treating multi-metal articles made of one or more of steel-(iron) and/or zinc-based metals, and aluminum-based metal, especially where the surface area of the aluminum-based metal comprises greater than 20%, more preferably greater than 35%, and even more preferably greater than 50% of the total surface area of the sum of the multi-metal articles passing through a treatment line. The articles are treated in accordance with the present invention by treating the articles with a coating composition suitable for providing a conversion coating on steel- and zinc-based metals, followed by treating the metal articles with a conversion coating capable of providing a conversion coating on aluminum-based metal articles. Metals capable of being processed in accordance with the invention to provide coated articles having good resistance to corrosion include, but are not limited to, steel, galvanized steel, aluminum, aluminum alloys and galvanized aluminum.

The coating composition suitable for providing a conversion coating on steel- and zinc-based metal articles comprises a phosphating coating composition, and more preferably a zinc-phosphate coating composition or an iron-phosphating coating composition.

Suitable zinc-phosphate coating compositions and their manner of use include those disclosed in U.S. Pat. Nos. 4,961,794 and 4,838,957, the entire disclosures of which, except to the extent that they may be inconsistent with any explicit statement herein, are incorporated herein by reference.

Suitable iron-phosphating coating compositions and their manner of use include those disclosed in U.S. Pat. Nos. 5,073,196 and 4,149,909, the entire disclosures of which, except to the extent that they may be inconsistent with any explicit statement herein, are incorporated by reference.

A particularly preferred aqueous, acidic, zinc-phosphate composition usable with the invention comprises:

(a) from 0.1 to 1.5 g/l, preferably from 0.5 to 1.4 g/l of zinc ion;

(b) from 5 to 50 g/l, preferably from 10 to 30 g/l, of phosphate ion;

(c) from 0.2 to 4 g/l, preferably from 0.6 to 3 g/l, of manganese ion;

(d) at least 0.05 g/l, preferably from 0.1 to 3 g/l, of fluoride ion;

(e) less than 0.5 g/l of chloride ion, and (f) a phosphating accelerator (conversion coating accelerator).

When the content of the zinc ion in the zinc-phosphate solutions usable in the invention is less than 0.1 g/l, an even phosphate film is not formed on the iron-based surfaces. When the zinc ion content exceeds 1.5 g/l in the zinc-phosphate solutions usable in the invention, then on both iron-based and zinc-based surfaces, continuing formation of the phosphate film occurs, causing a build-up of the film, with the result that the film shows a decrease in adhesion and becomes unsuitable as a substrate for cationic electrocoating.

When the content of phosphate ion in the zinc-phosphate solutions usable in the invention is less than 5 g/l, an uneven phosphate film is apt to be formed. When the phosphate ion content is more than 50 g/l in the zinc-phosphate solutions usable in the invention, no further benefits result, and it is therefore economically disadvantageous to use additional quantities of phosphate chemicals.

When the content of manganese ion is less than 0.2 g/l in the zinc-phosphate solutions usable in the invention, the manganese content in the phosphate film formed on zinc-based surfaces is very small; therefore the adhesion between the zinc-based substrate and the coating after the cationic electrocoating becomes insufficient. When the manganese ion is present in an amount of more than 4 g/l in the zinc-phosphate solutions usable in the invention, no further beneficial effects are obtained for the coating, and the solution forms excessive precipitates, making it impossible to obtain a stable solution.

It is preferred that the manganese content in the phosphate film formed on the steel-, and zinc-based metal articles be in the range of from 1 to 20% by weight, based on the weight of the film, in order to have a phosphate film which exhibits the performance requirements for cationic electrocoating. The content of manganese in the phosphate film can be determined according to conventional procedures, i.e., A.A. (Atomic Absorption Spectroscopy) or I.C.P.A.E.S. (Induction Coupled Plasma Atomic Emission Spectroscopy).

When the amount of fluoride ion in the zinc-phosphate solutions usable in the invention is less than 0.05 g/l, micronization of the phosphate film, improvement of corrosion-resistance after coating, and phosphating treatment at a reduced temperature cannot be attained. It is also important to have at least 0.05 g/l of fluoride ion in the zinc-phosphate solutions usable in the invention to tie up the dissolved aluminum in the phosphating solution. The fluoride ion can be present in the zinc-phosphate solutions usable in the invention in an amount above 3 g/l, but use thereof in such quantities provide no further benefits, and it is therefore economically disadvantageous to use additional quantities of fluoride ion. Preferably, the fluoride ion is contained in the form of a complex fluoride ion, e.g. the fluoroborate ion or the fluorosilicate ion, although the $F^-$ ion itself can also be used.

If chloride ion is employed in the zinc-phosphate solutions usable in the invention, it is preferred that its concentration not reach or exceed 0.5 g/l since it has been found that when the chloride ion concentration in the zinc-phosphating solution reaches or exceeds 0.5 g/l (500 ppm), an excessive etching reaction may occur which results in undesirable white spots on zinc surfaces and excessive dissolution of the aluminum-based substrates/articles being co-processed. Though the presence of chlorate ions themselves may not directly cause the development of white spots, they are gradually changed to chloride ions and accumulate in that form in the bath liquid thereby causing white spots as mentioned hereinabove. Furthermore, the combination of manganese and fluoride ions has been found to be effective for the formulation of useful zinc-phosphating solutions containing no chlorate ions.

In the zinc-phosphating solutions usable in the invention, it is preferably that the weight ratio of zinc ion to phosphate ion be 1:(10 to 30). In this ratio, an even phosphate film is obtained on the steel- and zinc-based articles which exhibits all of the performance requirements needed for cationic electrocoating. The weight ratio of zinc ion to manganese ion in the zinc-phosphate solutions usable in the invention is preferably 1:(0.5 to 2). In this ratio it is possible to obtain, in an economic manner, a phosphate film which contains the required amount of manganese and which displays all of the beneficial effects provided by the present invention.

In the zinc-phosphating solutions useable in the invention, it is desirable for the solutions to have a total acidity of 10 to 50 points, a free acidity of 0.3 to 2.0 points, and an acid ratio of 10 to 50. With the total acidity in the above range, the phosphate film can be obtained economically, and with the free acidity in the above range, the phosphate film can be obtained evenly without excessive etching of the metal surface. Adjustments in the solution to obtain and maintain the above points and ratio can be achieved by use of an alkali metal hydroxide or ammonium hydroxide as required.

Sources of the ingredients of the zinc-phosphating solutions of the invention include the following: as to the zinc ion; zinc oxide, zinc carbonate, zinc nitrate, etc.; as to the phosphate ion; phosphoric acid, zinc phosphate, zinc monohydrogen phosphate, zinc dihydrogen phosphate, manganese phosphate, manganese monohydrogen phosphate, manganese dihydrogen phosphate, etc.; as to the manganese ion, manganese carbonate, manganous oxide, manganese nitrate, the above manganese phosphate compounds, etc.; as to the fluoride ion; hydrofluoric acid, fluoroboric acid, fluorosilicic acid, fluorotitanic acid, and their metal salts (e.g., zinc salt, nickel salt, etc.; however, the sodium salt is excluded as it does not produce the desired effect); and as to the phosphating accelerator; sodium nitrite, ammonium nitrite, sodium m-nitrobenzenesulfonate, sodium m-nitrobenzoate, aqueous hydrogen peroxide, nitric acid, sodium nitrate, zinc nitrate, manganese nitrate, nickel nitrate, ferric nitrate, hydroxylamine (and salts and precursors thereof), etc.

The zinc-phosphating solutions useable in the invention can further contain, as an optional ingredient, nickel ion. The content of the nickel ion should preferably be from about 0.1 to about 4 g/l, preferably about 0.3 to about 2 g/l. When nickel ion is present with the manganese ion, performance of the resulting phosphate film is further improved, i.e., the adhesion and corrosion-resistance of the coating obtained after cationic electrocoating are further improved. In zinc-phosphating solutions containing nickel ion, the weight ratio of zinc ion to the sum of the manganese ion and the nickel ion is desirably 1:(0.5 to 5.0), preferably 1:(0.8 to 2.5). The supply source of nickel ion can be, for example, nickel carbonate, nickel nitrate, nickel phosphate, etc.

The step of phosphating metal surfaces by use of the zinc-phosphating solutions useable in the invention can be carried out by spray treatment, dip treatment, or by a combination of such treatments. Spray treatment can usually be effected by spraying 5 or more seconds in order to form an adequate phosphate film which exhibits the desired performance characteristics. As to this spray treatment, a treatment can be carried out using a cycle comprising first a spray treatment for about 5 to about 30 seconds, followed by discontinuing the treatment for about 5 to 30 seconds and then spray treating again for at least 5 seconds with a total spray treatment time of at least 40 seconds. This cycle can be carried out once or more than once.

Dip treatment is an embodiment which is more preferable than spray treatment in the zinc-phosphating process of the present invention. In order to form an adequate phosphate film which exhibits the desired performance characteristics, the dip treatment is usually effected for at least 15 seconds, preferably for about 30 to about 120 seconds. Also, treatment can he carried out by first dip treating for at least 15 seconds and then spray treating for at least 2 seconds. Alternatively, the treatment can be effected by first spray treating for at least 5 seconds, and then dip treating for at least 15 seconds. The former combination of first dip treating and then spray treating is especially advantageous for articles having complicated shapes like a car body. For such articles, it is preferable to first carry out a dip treatment for from about 30 to about 90 seconds, and then carry out the spray treatment for from about 5 to about 45 seconds. In this process, it is advantageous to effect the spray treatment for as long a time as is possible within the limitations of the automotive production line, in order to remove the sludge which adheres to the article during the dip treatment stage. In spray treatments, a convenient spray pressure is from 0.6 to 2 $Kg/cm^2G$.

In the phosphating stage, the treating temperature can be from about 30° C. to about 70° C. and preferably from about 35° C. to about 60° C. This temperature range is approximately 10° C. to 15° C. lower than that which is used in the prior art processes. Treating temperatures below 30° C. should not be used due to an unacceptable increase in the time required to produce an acceptable coating. Conversely, when the treating temperature is too high, the phosphating accelerator can become decomposed and excess precipitate may be formed causing the components in the solution to become unbalanced and making it difficult to obtain satisfactory phosphate films.

As described above, a preferred mode of treatment in the preferred phosphate coating process of the present invention is a dip treatment or a combined treatment using a dip treatment first and then a spray treatment.

One suitable procedure for applying a zinc-phosphate coating to metal surfaces is as follows:

The metal surface is first subjected to a spray treatment and/or a dip treatment with an alkaline degreasing agent at a temperature of 50° C. to 60° C. for 2 minutes; followed by washing with tap water; spray treatment and/or dip treatment with a surface conditioner at room temperature for 10 to 30 seconds; dip treatment with the zinc-phosphate solution at a temperature of about 30° C. to about 70° C. for at least 15 seconds and washing with tap water and then with deionized water, in that order.

The phosphate film formed by the zinc-phosphate solutions useable in the present invention is a zinc phosphate-type film. Such films formed on iron-based and zinc-based metal surfaces contain from about 25 to about 40 wt. % of zinc, from about 3 to about 11 wt. % of iron, from about 1 to about 20 wt. % of manganese, and from 0 to about 4 wt. % of nickel. It is preferred that the total mass of the zinc-phosphate coating dried into place onto the iron-based metal surfaces be 300–2,000 $mg/m^2$, and more preferably 500–1,500 $mg/m^2$. It is also preferred that the total mass of the zinc-phosphate coating dried into place onto the zinc-based metal surfaces be 700–4,000 $mg/m^2$, and more preferably 1,000–3,000 $mg/m^2$.

Phosphate films on aluminum-based substrates have very limited application, especially as the exposure to the aluminum-based metal articles to the phosphate coating source (i.e., bath) increases since exposure of high proportions of aluminum substrate surface area to the phosphate coating causes high amounts of contaminants to increase, namely aluminum ions, that will greatly hinder and retard phosphate coating formation making it commercially impractical and eventually results in the inability to form proper crystalline phosphate coatings on the aluminum article.

After the metal articles have been subjected to the phosphate treatment, they are then, preferably without subsequent drying, subjected for a relatively short period of time to a second treatment coating composition in order to at least provide a suitable conversion coating on the aluminum-based metal surfaces. Preferably, the second coating composition suitable for providing a conversion coating on aluminum-based metal surfaces comprises a ceramic composite treatment composition. A ceramic composite treatment composition is defined herein as a composition capable of forming a conversion coating on an aluminum-based metal surface which is predominantly inorganic in character (although a minor amount of the coating, e.g., less than 40 weight percent, more preferably less than 30 weight percent, may be organic, e.g., a polymer and/or resin). Examples of suitable ceramic composite treatment compositions can be found in U.S. Pat. Nos. 5,356,490, 5,281,282, 5,534,082 and 5,769,967 and International Published Application No. WO 00/26437, the entire disclosures of which, except to the extent that such disclosures may be inconsistent with any explicit statement herein, are incorporated herein by reference.

A particularly preferred ceramic composite treatment composition for use in this invention begins with a precursor composition that comprises, preferably consists essentially of, or more preferably consists of, water and:

(1) a first initial reagent component of at least one dissolved fluoroacid of an element selected from the group consisting of titanium, zirconium, hafnium, boron, aluminum, silicon, germanium, and tin; and (2) a second initial reagent component of one or more of dissolved, dispersed, or both dissolved and dispersed finely divided forms of (i) elements selected from the group consisting of titanium, zirconium, hafnium, boron, aluminum, silicon, germanium, and tin and (ii) all of oxides, hydroxides, and carbonates of all of titanium, zirconium, hafnium, boron, aluminum, silicon, germanium, and tin.

These necessary initial reagent components (1) and (2) are caused to chemically interact in such a manner as to produce a homogeneous composition. If initial reagent component (2) is present in dispersion rather than solution, as is generally preferred, the precursor composition normally will not be optically transparent, and completion of the desired interaction is indicated by the clarification of the composition. If reagent components (1) and (2), as defined above, are both present in the precursor aqueous composition in sufficiently high concentrations, adequate chemical interaction between them may occur at normal ambient temperatures (i.e., 20–25° C.) within a practical reaction time of 24 hours or less, particularly if component (2) is dissolved or is dispersed in very finely divided form. Mechanical agitation may be useful in speeding the desired chemical interaction and if so is preferably used. Heating, even to relatively low temperatures such as 30° C., is often useful in speeding the desired chemical interaction, and if so is also preferred. (The chemical interaction needed is believed most probably to produce oxyfluro complexes of the elements or their compounds of necessary initial reagent component (2), but the invention is not limited by any such theory.) The desired chemical interaction between components (1) and (2) of the mixed composition eliminates or at least markedly reduces any tendency toward settling of a dispersed phase that might otherwise occur upon long term storage of the initial mixture of water and components (1) and (2) as defined above.

The compositions resulting from the chemical interaction of (1) and (2) as described above may and often preferably do contain other optional components. Most often preferred among these optional components are water-soluble or -dispersible polymers, which preferably are selected from the group consisting of: (1) polymers of one or more x-(N—$R^1$—N—$R^2$-aminomethyl)-4-hydroxy-styrenes, where x (the substitution position number)=2, 3, 5 or 6, $R^1$ represents an alkyl group containing from 1 to 4 carbon atoms, preferably a methyl group, and $R^2$ represents a substituent group conforming to the general formula H $(CHOH)_nCH_2$—, where n is an integer from 1 to 7, preferably from 3 to 5 (these polymers are described immediately above in formal structural terms, but are usually in fact made by grafting the substituted aminomethyl groups onto some or all of the aromatic rings of a simple 4-hydroxystyrene polymer, as taught in U.S. Pat. No. 5,068,299 of Nov. 26,1991 to Lindert et al., the entire disclosure of which, except to any extent that it may be inconsistent with any explicit statement herein, is hereby incorporated herein by reference); (2) epoxy resins, particularly polymers of the diglycidyl ether of bisphenol-A, optionally capped on the ends with non-polymerizable groups and/or having some of the epoxy groups hydrolyzed to hydroxyl groups, and (3) polymers of acrylic and methacrylic acids and their salts.

Another optional component in the ceramic composite treatment composition according to this invention may be selected from the group consisting of water soluble oxides, carbonates, and hydroxides of the elements Ti, Zr, Hf, B, Al, Si, Ge, and Sn. Zirconium basic carbonate is a preferred example of this type of optional component. This component, as well as the other optional component describes in the immediately preceding paragraph, generally is preferably not present in the precursor mixture of water and necessary initial reagent components (1) and (2) before the chemical interaction that converts this mixture into a stable homogeneous mixture as described above is complete.

The resulting ceramic composite treatment composition is suitable for treating aluminum-based metal surfaces and phosphate coated steel- and zinc-based metal surfaces to achieve acceptable resistance to corrosion and/or paint adhesion. The ceramic composite treating process may comprise either of coating the phosphate coated steel- and zinc-based metals and the essentially phosphate coating-free aluminum-based metals with a liquid film of the ceramic composite treatment composition and then drying this liquid film in place on the surface of the metal, or simply contacting the metal with the ceramic composite treatment composition for a sufficient time to produce an improvement in the resistance of the surface to corrosion, and/or paint adhesion, and subsequently rinsing before drying. Such contact (i.e., exposure) may be achieved by spraying, immersion, and the like as known in the art. When this latter method is used, it is optional, and often advantageous, to contact the metal surface with an aqueous composition comprising polymers and copolymers of one or more x-(N—$R^1$—N—$R^2$-aminomethyl)-4-hydroxy-styrenes, where x, $R^1$, and $R^2$ have the same meanings as already described above, after (i) contacting the metal with a composition containing a product of reaction between initial reagent components (1) and (2) as described above, (ii) removing the metal from contact with this composition containing components (1) and (2) as described above, and (iii) rinsing with water, but before drying.

Necessary initial reagent component (1) preferably is selected from the group consisting of $H_2TiF_6$, $H_2ZrF_6$, $H_2HfF_6$, $H_2SiF_6$, and $HBF_4$; $H_2TiF_6$, $H_2ZrF_6$, $H_2SiF_6$ are more preferred; and $H_2TiF_6$ is most preferred. The concentration of fluoroacid component at the time of its interaction with initial reagent component (2) preferably is at least, with increasing preference in the order given, 0.01, 0.05, 0.10, 0.15, 0.20, 0.25, or 0.30 moles of the fluoroacid per liter of the reaction mixture, a concentration unit that may be used hereinafter for other constituents in any liquid mixture and is hereinafter usually abbreviated as "M" and independently preferably is not more than, with increasing preference in the order given, 7.0, 6.0, 5.0, 4.0, 3.5, 3.0, 2.5, 2.0, 1.8, 1.6, 1.4, or 1.2 M.

Initial reagent component (2) of metallic and/or metalloid elements and/or their oxides, hydroxides, and/or carbonates is preferably selected from the group consisting of the oxides, hydroxides, and/or carbonates of silicon, zirconium, and/or aluminum and more preferably includes silica. Any form of this component that is sufficiently finely divided to be readily dispersed in water may be reacted with component (1) to form the necessary component in a composition according to this invention as described above. For any constituent of this component that may have low solubility in water, it is preferred that the constituent be amorphous rather than crystalline, because crystalline constituents can require a much longer period of heating and/or a higher temperature of heating to produce a composition that is no longer susceptible to settling and optically transparent. Solutions and/or sols such as silicic acid sols may be used, but it is highly preferable that they be substantially free from alkali metal ions as described further below. However, it is generally most preferred to use dispersions of silica made by pyrogenic processes.

An equivalent of a constituent of necessary initial reagent component (2) is defined for the purposes of this description as the amount of the material containing a total of Avogadro's Number (i.e., $6.02\times10^{23}$) of atoms of elements selected from the group consisting of Ti, Zr, Hf, B, Al, Si, Ge, and Sn. The ratio of moles of fluoroacid initial reagent component (1) to total equivalents of initial reagent component (2) in an aqueous composition in which these two initial reagent components chemically interact to produce a necessary component of a composition according to this invention preferably is at least, with increasing preference in the order given, 1.0:1.0, 1.3:1.0, 1.6:1.0, or 1.9:1.0 and independently preferably is not more than, with increasing preference in the order given, 50:1.0, 35:1.0, 20:1.0, 15:1.0, or 5.0:1.0. If desired, a constituent of this component may be treated on its surface with a silane coupling agent or the like that makes the surface oleophilic.

Components (1) and (2) may be combined/mixed in accordance with any suitable manner. However, according to a preferred method of preparing the product of chemical interaction between initial reagent components (1) and (2) that is necessary to this invention, an aqueous liquid composition comprising, preferably consisting essentially of, or more preferably consisting of, water and initial reagent compositions (1) and (2) as described above, which composition scatters visible light, is not optically transparent in a thickness of 1 cm, and/or undergoes visually detectable settling of a solid phase if maintained for at least 100 hours at a temperature between its freezing point and 20° C., is maintained at a temperature of at least 21° C., optionally with mechanical agitation, for a sufficient time to produce a composition that (i) does not suffer any visually detectable settling when stored for a period of 100, or more preferably 1000, hours and (ii) is optically transparent in a thickness of 1 cm.

Preferably, the temperature at which the initial mixture of components (1) and (2) is maintained is in the range from 25° C. to 100° C., or more preferably within the range from 30° C. to 80° C., and the time that the composition is maintained within the stated temperature range is within the range from 3 to 480, more preferably from 5 to 90, or still more preferably from 10 to 30, minutes (hereinafter often abbreviated as "min"). Shorter times and lower temperatures within these ranges are generally adequate for completion of the needed chemical interaction when initial reagent component (2) is selected only from dissolved species and/or dispersed amorphous species without any surface treatment to reduce their hydrophilicity, while longer times and/or higher temperatures within these ranges are likely to be needed if initial reagent component (2) includes dispersed solid crystalline materials and/or solids with surfaces treated to reduce their hydrophilicity. With suitable equipment for pressurizing the reaction mixture, even higher temperatures than 100° C. can be used in especially difficult instances.

Independently, it is preferred that the pH of the aqueous liquid composition combining reagent components (1) and (2) as described above be kept in the range from 0 to 4, more preferably in the range from 0.0 to 2.0, or still more preferably in the range from 0.0 to 1.0 before beginning maintenance at a temperature of at least 21° C. as described above. This pH value is most preferably achieved by using appropriate amounts of components (1) and (2) themselves rather than by introducing other acidic or alkaline materials.

After completion of the necessary chemical interaction between initial reagent components (1) and (2) as described above, any desired optional component may be mixed in any order with the product of the chemical interaction between components (1) and (2) and the water in which the interaction occurred. If the mixture of water and the interaction product (1) and (2) has been heated to a temperature above 30° C., it is preferably brought below that temperature before any of the other components are added.

Preferably, the optional component of water-soluble polymers is included in the aqueous ceramic composite treatment composition as described above, more preferably in an amount such that the ratio by weight of this optional component to the total of initial reagent component (1) as described above is at least, with increasing preference in the order given, 0.05:1.0, 0.10:1.0, 0.15:1.0, 0.20:1.0, 0.25:1.0, 0.30:1.0, 0.35:1.0, or 0.38:1.0 and independently preferably is not more than, with increasing preference given, 3.0:1.0, 2.5:1.0, 2.0:1.0, 1.6:1.0, 1.2:1.0, 0.90:1.0, 0.70:1.0, 0.60:1.0, 0.55:1.0, 0.50:1.0, or 0.45:1.0.

In one embodiment of the invention, it is preferred that the acidic aqueous ceramic composite treatment composition as noted above be applied (i.e., exposed) to the pre-treated metal surface (i.e., the metals treated with the phosphate treatment coating composition) and dried in place thereon. For example, coating the pre-treated metal with a liquid film may be accomplished by immersing the surface in a container of the liquid composition, spraying the composition on the surface, coating the surface by passing it between upper and lower rollers with the lower roller immersed in a container of the liquid composition, and the like, or by a mixture of methods. Excessive amounts of the liquid composition that might otherwise remain on the surface prior to drying may be removed before drying by any convenient method, such as drainage under the influence of gravity, squeegees, passing between coating rolls, and the like.

If the surface to be coated is a continuous flat sheet or coil and precisely controllable coating techniques such as gravure roll coaters are used, a relatively small volume per unit area of a concentrated ceramic composite treatment composition may effectively be used for direct application. On the other hand, if the coating equipment used does not readily permit precise coating at low coating add-on liquid volume levels, it is equally effective to use a more dilute acidic aqueous ceramic composite treatment composition to apply a thicker liquid coating that contains about the same amount of active ingredients. In either case and regardless of whether the liquid coating is dried in place or subjected to one or more rinsing steps before drying, it is preferred that the total mass of the ceramic composite treatment coating dried into place on the surface that is treated should be at least, with increasing preference in the order given, 10, 20, 40, 75, 100, 150, 200, 250, 300, 325, 340, or 355 milligrams per square meter of substrate surface area treated (hereinafter often abbreviated as "$mg/m^2$") and independently, primarily for reasons of economy, preferably is not more than, with increasing preference in the order given, 1000, 750, 600, 600, 450, or 400 $mg/m^2$.

Drying may be accomplished by any convenient method, of which many are known in the art; examples are hot air and infrared radiative drying. Independently, it is preferred that the maximum temperature of the metal reached during drying fall within the range from 30° C. to 200° C., more preferably from 30° C. to 150° C., still more preferably from 30° C. to 75° C. Also independently, it is often preferred that the drying be completed within a time ranging from 0.5 to 300, more preferably from 2 to 50, still more preferably from 2 to 10, seconds (hereinafter abbreviated "sec") after coating is completed.

According to an alternative embodiment of the invention, the pre-treated metals to be treated preferably are contacted with the ceramic composite treatment composition prepared as described above at a temperature that is at least, with increasing preference in the order given, 15, 17, 19 or 21° C. and independently preferably, primarily for economy, is not more than, with increasing preference in the order given, 90, 85, 80, 75, 70, 65, 60, 55, 50 or 45° C.

Independently, the time of active contact (exposure) of the ceramic composite treatment composition with the metal surface is at least, with increasing preference in the order given, 1, 3, or 5 sec and independently preferably is not more than, with increasing preference in the order given, 120, 90, 60, 30 or 15 sec, and the metal surface thus treated with the ceramic composite treatment composition is subsequently rinsed with water in one or more stages before being dried. "Active" contact is defined herein as exposing the metal surface to the ceramic composite treatment composition while the composition is being agitated or circulated in some manner (by spraying or dipping for example) such that fresh portions of the composition are being brought into contact with the metal surface on a substantially continuous basis. In this embodiment, at least one rinse after treatment with the ceramic composite treatment composition according this invention preferably is with deionized, distilled, or otherwise purified water. Rinsing in this manner may be utilized to ensure that the conversion coating finally formed on the aluminum-based surface is ceramic in character (i.e., predominantly inorganic).

The ceramic composite treatment composition has the unique ability to continue coating formation after active contact (by spraying, dipping, etc.) has stopped. As such, it is preferred that the articles be allowed to sit (i.e., not brought into contact with fresh portions of the ceramic composite treatment composition) for a period of 15–240 sec, more preferably 15–120 sec, and most preferably 30–60 sec before being rinsed, heat dried, or otherwise subsequently processed. For example, in a preferred embodiment of the invention the article to be treated is sprayed with the composition or dipped into a tank containing a bulk amount of the composition for the desired active contact time (e.g., from 1 to 120 seconds). After this period of time, spraying is discontinued or the article is withdrawn from the tank. No further processing operations are carried out on the article, which is coated with a wet film of the composition, for a period of time (e.g., 15 to 240 seconds). It has been found that this combination of processing steps (a relatively short active contact time followed by a delay in further processing) helps to minimize removal of the zinc or iron phosphate conversion coating from the surface of the steel- or zinc-based metal.

Also in this embodiment, it is preferred that the maximum temperature of the metal reached during drying fall within the range from 30° C. to 200° C., more preferably from 30° C. to 150° C., or still more preferably from 30° C. to 75° C. and that, independently, drying be completed within a time ranging from to 0.5 to 300, more preferably from 2 to 50, still more preferably from 2 to 10, sec after the last contact of the treated metal with a liquid before drying is completed.

After the multi-metal articles are treated with the phosphating and the ceramic composite treatment compositions, the steel- and zinc-based metals are coated with a phosphate layer chemically bonded to and mechanically adhering to and overlying the metal, and a ceramic composite layer bonded to and mechanically adhering to and overlying the phosphate layer. The aluminum-based metal is coated with a ceramic composite layer overlying the metal. The phosphate that chemically bonds to the steel- and zinc-based metals does not chemically bond to the aluminum-based metal with any regular or long-term success. The ceramic composite layer bonded to and mechanically adhering to the phosphate layer provides additional corrosion protection to the steel- or zinc-based metal beyond what is furnished by the zinc or iron phosphate conversion coating. It has not been previously appreciated that ceramic composite treatment compositions of the type described herein could be successfully used to form a conversion coating on top of a zinc or iron phosphate conversion coating layer, as such compositions had only been used to treat uncoated "bare" metal surfaces.

The coated metals can then be directly painted with any conventional paint. Examples of suitable paints include, but are not necessarily limited to, PPG Duracron™ 1000 White Single Coat Acrylic Paint, Lilly™ Colonial White Single Coat Polyester, Valspar/Desoto™ White Single Coat Polyester, Valspar™ Colonial White Single Coat Polyester, and Lilly™ Black Single Coat Polyester.

Preferably, any metal surface to be treated according to the invention is first cleaned of any contaminants, particularly organic contaminants and metal fines and/or foreign metal inclusions. Such cleaning may be accomplished by methods known to those skilled in the art and adapted to the particular type of metal substrate to be treated. For example, for galvanized steel surfaces, the substrate is most preferably cleaned with a conventional hot alkaline cleaner, then rinsed with hot water, squeegeed, and dried. For aluminum, the surface to be treated most preferably is first contacted with a conventional hot alkaline cleaner, then rinsed in hot water, then, optionally, contacted with a neutralizing acid rinse, before being contacted with the treatment compositions.

In a preferred process, the metal articles are first cleaned using any suitable conventional metal cleaner. An example of a suitable cleaner comprises a Parco® series cleaner, and more preferably Parcolene® 319MM-2%, available from Henkel Corp. in Madison Heights, Mich. Preferably, the Parcolene® 319MM is at a temperature of about 49–77° C., and more preferably about 60° C. The metal articles are then preferably rinsed with water, more preferably deionized water, and dried.

The metal articles are then surface conditioned using any suitable conventional surface conditioner. An example of a suitable surface conditioner comprises a Parco® series surface conditioner, and more preferably Parcolene® Z-10, available from Henkel Corp. in Madison Heights, Mich. Preferably, the Parcolene® Z-10 is at a pH of 7–11, and more preferably about 9.5. The metal articles are then preferably rinsed with water, more preferably deionized water, and dried.

The metal articles are then treated with the suitable phosphate coating composition capable of providing a conversion coating on steel- and zinc-based metals. An example of a suitable zinc-phosphate coating composition comprises a Bonderite® series zinc-phosphate coating composition, and more preferably Bonderite® 958, available from Henkel Corporation in Madison Heights, Mich. Preferably, the Bonderite® 958 is at a temperature of about 38–65° C., and more preferably about 50° C. An example of a suitable iron-phosphate conversion coating composition comprises Bonderite® 1030, available from Henkel Corporation in Madison Heights, Mich. The metal articles are then preferably rinsed with water, more preferably deionized water, and dried.

The metal articles are then treated using the ceramic composite treatment coating composition of the invention that is capable of providing a conversion coating on aluminum-based metals. Examples of a suitable ceramic composite treatment coating composition comprise a 1–4% composition of examples 1–10 contained within International published application No. WO 00/26437. Another example includes Alodine® 5200 available from Henkel Corporation of Madison Heights, Mich. Preferably, the ceramic composite treatment coating composition is at a pH of 1–5, and more preferably about 3.0–3.6. The metal articles are then preferably rinsed with water, more preferably deionized water, and dried.

The metal articles are then suitable for further paint (or other type of finish) processing as is known in the art.

The practice of this invention may be further appreciated by the consideration of the following, non-limited working example.

EXAMPLE

Test pieces of aluminum and cold rolled steel were cleaned with an alkaline cleaner for two minutes. The test pieces were then rinsed twice and exposed to a titanium activator (conditioner). The test pieces were then sprayed with the zinc-phosphate conversion coating Bonderite® 958 for two minutes. The test pieces were then rinsed twice and sprayed for five seconds with an Alodine® 5200 solution. The test pieces were allowed to sit after spraying for 30–60 seconds prior to undergoing two subsequent rinsing steps. The test pieces were then painted with a standard PPG automotive E-coat composition (0.5–0.9 mil) which was then oven cured, and then coated with a polyester powder paint (1.8–2.5 mils), followed by a subsequent oven cure.

The aluminum test piece was exposed to a 1,500 hour salt spray in accordance with ASTM B-117. No corrosion was observed on the aluminum test piece. The cold rolled steel test piece was then exposed to 336 hour salt spray in accordance with ASTM B-117. No corrosion was observed on the cold rolled steel test piece.

Except where otherwise expressly indicated, all numerical quantities indicating amounts of material or conditions of reaction and/or use herein are to be understood as modified by the word "about" in describing the broadest scope of the invention. Practice within the numerical limits stated is generally preferred. Also, unless expressly stated to the contrary: percent, "parts of", and ratio values are by weight based on total weight of the composition of solutions; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole, and any counterions thus implicitly specified should preferably be selected from among other constituents explicitly specified in ionic form, to the extent possible; otherwise such counterions may be freely selected, except for avoiding counterions that act adversely to the objects of the invention; the term "mole" means "gram mole", and "mole" and its variations may be applied herein to ionic or any other chemical species with defined numbers and types of atoms, as well as to chemical substances with well defined conventional molecules.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for sequentially treating one or more (multi-metal articles, said method comprising:

exposing the one or more of the multi-metal articles to a phosphating composition capable of providing a conversion coating on steel- and zinc-based metals; and exposing the one or more articles to a ceramic composite treatment composition capable of providing a conversion coating on aluminum-based metal, the ceramic composite treatment composition comprising:

(A) an aqueous composition comprising the product of chemical interaction between:

(1) a first reagent component selected from the group consisting of fluoroacids of the elements of titanium, zirconium, hafnium, boron, aluminum, silicon, germanium, and tin, the first reagent component being dissolved in water; and (2) a second reagent component selected from the group consisting of titanium, zirconium, hafnium, boron, aluminum, silicon, germanium, tin and all of oxides, hydroxides, and carbonates of all of titanium, zirconium, hafnium, boron, aluminum, silicon, germanium, and tin, the second regent component dissolved, dispersed or both dissolved and dispersed in water.

2. The method of claim 1, wherein the phosphating composition is a zinc-phosphating composition comprising zinc ion and phosphate ion, wherein the weight ratio of the zinc ion to phosphate ion in the zinc-phosphating composition is between 1:(10–30).

3. The method of claim 2, wherein the zinc-phosphating composition further comprises fluoride ion present in an amount of about 0.5 to 3 g/l.

4. The method of claim 3, wherein the zinc-phosphating composition has a total acidity of 10 to 50 points, a free acidity of 0.3 to 2.0 points and an acid ratio of 10 to 50.

5. The method of claim 3, wherein the zinc-phosphating composition further comprises chloride ion.

6. The method of claim 1, wherein any phosphate film formed on the metal articles comprises 1–20 weight percent manganese, based on the weight of the phosphate film.

7. The method of claim 3, wherein the zinc-phosphating composition comprises:

(a) from 0.1 to 1.5 g/l of zinc ion;

(b) from 5 to 50 g/l of phosphate ion;

(c) from 0.2 to 4 g/l of manganese ion;

(d) from 0.05 to 3 g/l of fluoride ion;

(e) less than 0.5 g/l of chloride ion, and (f) a conversion coating phosphating accelerator.

8. The method of claim 7, wherein the zinc-phosphating composition comprises:

(a) from 0.5 to 1.4 g/l of zinc ion;

(b) from 10 to 30 g/l of phosphate ion;

(c) from 0.6 to 3 g/l of manganese ion;

(d) from 0.1 to 3 g/l of fluoride ion;

(e) less than 0.5 g/l of chloride ion, and (1) a conversion coating phosphating accelerator.

9. The method of claim 8, wherein the zinc-phosphating composition further comprises nickel ion in an amount of 0.1 to 4 g/l.

10. The method of claim 3, wherein the zinc-phosphating composition is exposed to the articles at a temperature of between 30° C to 70° C.

11. The method of claim 1, wherein an amount corresponding to a total concentration of at least about 0.05 M of fluoroacids selected from the group consisting of $H_2SiF_6$, $H_2TiF_6$, and $H_2ZrF_6$ is reacted to make component (A) of the ceramic composite treatment composition, and an amount of second initial reagent that is selected from the group consisting of the oxides, hydroxides, and carbonates of all of silicon, zirconium, and aluminum and that corresponds to a number of moles of the second initial reagent such that the ratio of the number of moles of fluoroacids to the number of moles of the second initial reagent that are reacted to make component (A) is within a range from about 1.0:1.0 to 50:1.0.

12. The method of claim 1, wherein the ceramic composite treatment composition additionally comprises water soluble polymers of one or more x-(N-$R^1$-N-$R^2$-aminomethyl)-4-hydroxy-styrenes, where x (the substitution position number) 2, 3, 5, or 6, $R^1$ represents an alkyl group consisting of 1 to 4 carbon atoms, and $R^2$ represents a substituent group conforming to the general formula $H(CHOH)_nCH_2$-, where n is an integer from 3 to 5.

13. A method for sequentially treating one or more multi-metal articles, said method comprising:

exposing the one or more of the multi-metal articles to a phosphating composition capable of providing a conversion coating on steel- and zinc-based metals; and exposing the one or more articles to a ceramic composite treatment composition capable of providing a conversion coating on aluminum-based metal, the ceramic composite treatment composition comprising:

(A) an aqueous composition comprising the product of chemical interaction between:

(1) a first reagent component selected from the group consisting of fluoroacids of the elements of titanium, zirconium, hafnium, boron, aluminum, silicon, germanium, and tin, the first reagent component being dissolved in water; and (2) a second reagent component selected from the group consisting of titanium, zirconium, hafnium, boron, aluminum, silicon, germanium, tin and all of oxides, hydroxides, and carbonates of all of titanium, zirconium, hafnium, boron, aluminum, silicon, germanium, and tin, the second regent component dissolved, dispersed or both dissolved and dispersed in water, wherein an amount corresponding to a total concentration of at least about 0.15 M of $H_2TiF_6$, and $H_2ZrF_6$ is reacted to make component (A) of the ceramic composite treatment composition, and an amount of silica that corresponds to a number of moles of silica such that the ratio of the number of moles of fluoroacids to the number of moles of silica that are reacted to make component (A) is within a range from about 1.6:1.0 to 5.0:1.0.

14. The method of claim 1, wherein the multi-metal articles have total aluminum-based metal content of more than 20 percent, based on the total surface area of the articles.

15. The method of claim 9, wherein the weight ratio of zinc ion to the sum of the manganese ion and the nickel ion is between 1:(0.5–5.0).

16. The method of claim 1, wherein the ratio of moles of the first reagent component (1) to total equivalents of the second reagent component (2) in the ceramic composite treatment composition comprises 1.0:1.0 to 50:1.0.

17. The method of claim 1, wherein the amount of time that the ceramic composite treatment composition is exposed to the one or more articles comprises between 1–120 seconds.

18. A method for sequentially treating one or more multi-metal articles, said method comprising:

exposing the one or more of the multi-metal articles to a phosphating composition capable of providing a conversion coating on steel- and zinc-based metals; and exposing the one or more articles to a ceramic composite treatment composition capable of providing a conversion coating on aluminum-based metal, the ceramic composite treatment composition comprising:

(A) an aqueous composition comprising the product of chemical interaction between:

(1) a first reagent component selected from the group consisting of fluoroacids of the elements of titanium, zirconium, hafnium, boron, aluminum, silicon, germanium, and tin, the first reagent component being dissolved in water; and (2) a second reagent component selected from the group consisting of titanium, zirconium, hafnium, boron, aluminum, silicon, germanium, tin and all of oxides, hydroxides, and carbonates of all of titanium, zirconium, hafnium, boron, aluminum, silicon, germanium, and tin, the second regent component dissolved, dispersed or both dissolved and dispersed in water, wherein after the one or more articles ceases being exposed to the ceramic composite treatment composition, the one or more articles undergoes no further coating, washing, or heated drying for a period of 15–240 seconds.

19. The method of claim 1, wherein the phosphating composition comprises an iron-phosphating composition.

20. A steel and or zinc based article treated in accordance with the method of claim 1, wherein the article is a multi-metal article and is coated with a first phosphate layer adhering to and overlying the article, and a ceramic composite layer adhering to and overlying the phosphate layer.

21. An aluminum-based article treated in accordance with the method of claim 1, wherein the article is a multi-metal article and is coated with a ceramic composite layer overlying and adhering to the article.

22. An article comprising a first portion that is made of steel-, and/or zinc-based metal, and a second portion that is made of aluminum-based metal, wherein the first portion of the article is coated with a first phosphate layer adhering to and overlying the first portion of the article, and a ceramic composite layer adhering to and overlying both the phosphate layer and the second portion of the article.

23. The article of claim 22 wherein the ceramic composite layer has a total mass on the article of at least 40 milligrams per square meter of article surface.

24. The method of claim 1, wherein the second reagent component (2) comprises one or more of dissolved, dispersed, or both dissolved and dispersed finely divided forms of (i) elements selected from the group consisting of titanium, zirconium, hafnium, boron, aluminum, silicon, germanium, and tin and (ii) all of oxides, hydroxides, and carbonates of all of titanium, zirconium, hafnium, boron, aluminum, silicon, germanium, and tin.

25. The method of claim 1, wherein the second reagent component (2) is selected from the group consisting of oxides, hydroxides, and carbonates of silicon, zirconium, and aluminum.

26. The article of claim 22, wherein the article is prepared by:

exposing the article to a phosphating composition capable of providing a conversion coating on steel- and zinc-based metals; and exposing the article to a ceramic composite treatment composition capable of providing a conversion coating on aluminum-based metal, the ceramic composite treatment composition comprising:

(A) an aqueous composition comprising the product of chemical interaction between:

(1) a first reagent component selected from the group consisting of fluoroacids of the elements of titanium, zirconium, hafnium, boron, aluminum, silicon, germanium, and tin, the first reagent component being dissolved in water; and (2) a second reagent component selected from the group consisting of titanium, zirconium, hafnium, boron, aluminum, silicon, germanium, tin and all of oxides, hydroxides, and carbonates of all of titanium, zirconium, hafnium, boron, aluminum, silicon, germanium, and tin, the second regent component dissolved, dispersed or both dissolved and dispersed in water.

* * * * *

UNITED STATES PATENT AND TRADEMARK OFFICE

CERTIFICATE OF CORRECTION

PATENT NO. : 6,733,896 B2 
DATED : May 11, 2004
INVENTOR(S) : Shawn E. Dolan, Michael J. Kay and Lawrence R. Carlson It is certified that error appears in the above-identified patent and that said Letters Patent is hereby corrected as shown below:

Column 13,
Line 54, after "more" delete "(".

Column 14,
Line 43, delete "(1)" and insert -- (f) --.

Signed and Sealed this

Tenth Day of August, 2004

JON W. DUDAS
*Acting Director of the United States Patent and Trademark Office*